United States Patent [19]

Cook et al.

[11] 4,154,643

[45] May 15, 1979

[54] RECOVERY PROCESS AND APPARATUS FOR ALKALI METAL-CONTAINING SPENT LIQUOR

[75] Inventors: William R. Cook; Donald R. Sheeley; Joel A. Tyner, all of Hartsville, S.C.

[73] Assignee: Sonoco Products Company, Hartsville, S.C.

[21] Appl. No.: 875,150

[22] Filed: Feb. 6, 1978

[51] Int. Cl.[2] ..... D21C 11/02; D21C 11/12

[52] U.S. Cl. ..... 162/30 R; 422/185; 110/247; 162/36; 162/240; 423/182; 423/207; 423/DIG. 3

[58] Field of Search ..... 162/30 R, 30 K, 36, 162/239, 240; 423/207, 121, 122, 127, 129, 182, 183, DIG. 3; 23/262, 277 R, 313 R; 110/247; 202/104

[56] References Cited

U.S. PATENT DOCUMENTS

| | | | |
|---|---|---|---|
| 2,314,112 | 3/1943 | Tuttle | 202/104 |
| 2,433,498 | 12/1947 | Whitford | 23/277 R |
| 2,792,350 | 5/1957 | Bradley et al. | 162/36 |
| 2,849,292 | 8/1958 | Shick | 23/262 |
| 2,862,887 | 12/1958 | Boyer | 162/30 R |
| 2,864,669 | 12/1958 | Ahlborg et al. | 162/36 |
| 3,061,408 | 10/1962 | Lurie | 162/36 |
| 3,787,283 | 1/1974 | Sheeley et al. | 162/30 R |
| 4,035,228 | 7/1977 | Sheeley et al. | 162/30 R |

*Primary Examiner*—S. Leon Bashore
*Assistant Examiner*—Peter F. Kratz
*Attorney, Agent, or Firm*—Bell, Seltzer, Park & Gibson

[57] ABSTRACT

An alkali metal-containing spent liquor is treated to recover the alkali metal content for reuse without the need for recycling furnace ash and forming solid pellets therefrom. A mixture of aluminum hydrate and alkali metal-containing waste liquor is directed through a heated furnace and dried to form granules of the aluminum hydrate and waste liquor solids, and the organic content of the granules are combusted and reacted to form granular alkali metal aluminate furnace ash. The granular furnace ash is removed from the furnace and treated to recover the alkali metal and to produce aluminum hydrate for reuse in the process.

9 Claims, 4 Drawing Figures

VENT
102
140
142
141
WATER SUPPLY
70
80
ABSORBER
71
HEAT EXCHANGER
72
76
73
68
GAS COOLER
67
100
STEAM
WASTE HEAT BOILER
65
64
95
122
HEATED WATER 20
61
CYCLONE
MULTI-HEARTH FURNACE
30
36
38
35
32
37
AIR
41
42
40
43
39
FLUIDIZED BED COOLER
GRANULATOR
44
ASH SURGE BIN
45
62
63
93
92
95
SURGE TANK
101
130
123
CAKE WASH TANK
117
103
124
125
14
120
BELT WASHER
116
115
BELT WASH TANK
20
105
13
15
12
18
ALUMINA MAKE-UP STORAGE
17
MIXER TANK
16
VACUUM RECEIVER
106
109
11
RECOVERED CHEMICAL STORAGE
110
TO PULP MILL
HEAVY LIQUOR STORAGE
10

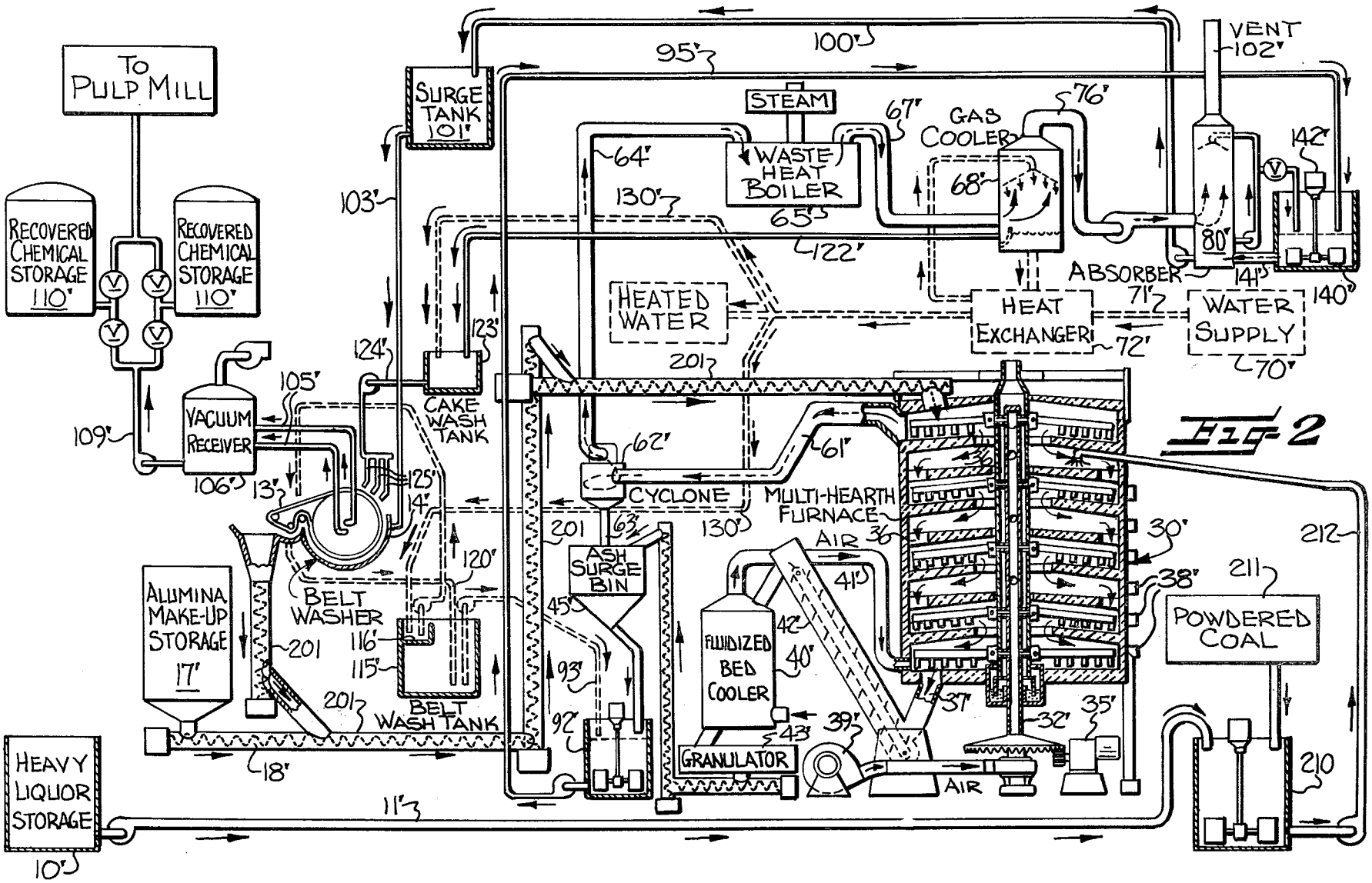
VENT
102'
142'
140'
141'
80'
WATER SUPPLY
70'
ABSORBER
71'
72'
HEAT EXCHANGER
76'
GAS COOLER
68'
67'
100'
STEAM
WASTE HEAT BOILER
65'
122'
95'
64'
130'
HEATED WATER
201
SURGE TANK
101'
103'
123'
124'
CAKE WASH TANK
105'
VACUUM RECEIVER
106'
109'
RECOVERED CHEMICAL STORAGE
110'
TO PULP MILL
FIG 2
212
210
211
POWDERED COAL
30'
38'
35'
32'
37'
AIR
36'
MULTI-HEARTH FURNACE
61'
62'
CYCLONE
130'
41'
42'
40'
43'
39'
FLUIDIZED BED COOLER
GRANULATOR
ASH SURGE BIN
63'
45'
93'
92'
120'
125'
14'
BELT WASHER
116'
115'
BELT WASH TANK
13'
18'
11'
ALUMINA MAKE-UP STORAGE
17'
HEAVY LIQUOR STORAGE
10'

RECOVERY PROCESS AND APPARATUS FOR ALKALI METAL-CONTAINING SPENT LIQUOR

In commonly owned Sheeley et al. U.S. Pat. No. 3,787,283 issued Jan. 22, 1974 and Sheeley et al. U.S. Pat. No. 4,035,228 issued July 12, 1977, there is disclosed a process and apparatus for recovering the alkali metal from alkali metal-containing waste liquors, such as pulping liquors in which concentrated spent liquor is mixed with alumina (aluminum hydrate) and with recycled alkali metal aluminate furnace ash and formed into solid pellets. The solid pellets are processed through a suitable furnace operating at a temperature below the fusion temperature of the alkali metal aluminate to combust the organic content of the pellets and convert the alkali metal content of the waste liquor to alkali metal aluminate. Upon leaving the furnace, the pellets are pulverized and a portion of the pulverized furnace ash is recycled for subsequent reuse in the formation of pellets. The remaining portion of the ash is dissolved in water to form a solution of alkali metal aluminate. The alkali metal aluminate solution is reacted with an acidic oxide gas to precipitate aluminum hydrate and permit recovery of the alkali metal solution in a suitable separation step such as filtration.

The combustion and reaction of the waste liquor in the process of the above-noted patents is carried out in a non-molten solid state and therefore has numerous advantages over earlier processes which involve the formation of a molten sticky smelt, examples of which are set forth in U.S. Pat. Nos. 2,792,350; 2,862,887; 2,864,669; 2,849,292; and 3,061,408.

Heretofore, it was thought that in carrying out the chemical reactions utilized in the solid state recovery process in the aforementioned Sheeley et al patents, recycled alkali metal aluminate furnace ash was needed as a carrier material to permit handling and reacting the aluminum hydrate and waste liquor in solid form.

The present invention, however, provides a method and apparatus whereby the reactions utilized in the aforementioned earlier Sheeley et al patents may be carried out in a solid state without the necessity of recycling furnace ash and forming pellets therefrom as was disclosed in these earlier patents. Consequently, the present invention presents numerous advantages over the process and apparatus disclosed in the earlier Sheeley et al patents.

For example, in the process and apparatus of the earlier Sheeley et al patents, energy is required for raising the recycled furnace ash to combustion temperature along with the liquor solids and aluminum hydrate, and for subsequently cooling the pelletized ash. Various pieces of apparatus are needed for forming the pellets and handling and conveying the same during the combustion and recycling operations. Additionally, the considerable mass of the recycled furnace ash in the system must be taken into account in determining the size of this apparatus.

By eliminating the dead load of the recycled furnace ash in the system, it will be appreciated that the present invention provides a significant reduction in the size and initial cost of the apparatus used for carrying out a solid state recovery process, and provides attendant reductions in energy consumption and operating costs.

In accordance with the present invention, the same furnace is used for drying the waste liquor, for forming granules of the aluminum hydrate and waste liquor solids, and for combusting and reacting the granules.

Additionally, if desired, the same furnace can be also utilized in subsequently cooling the granules after combustion and prior to further processing.

More specifically, the process of the present invention involves directing a mixture of alumina (aluminum hydrate) and alkali metal-containing waste liquor through a heated furnace operating at a temperature below the fusion temperature of alkali metal aluminate while drying the mixture in the furnace and forming dried granules of aluminum hydrate and waste liquor solids, and while combusting the organic content of the granules and reacting the alkali metal content of the granules with the aluminum hydrate to form granular alkali metal aluminate furnace ash. The granular alkali metal aluminate furnace ash is removed from the furnace, dissolved in water to form a solution of alkali metal aluminate, and acidified to precipitate aluminum hydrate and produce a slurry of insoluble aluminum hydrate in a solution containing the alkali metal. The insoluble aluminum hydrate is separated and may be reused in mixing with waste liquor, and the alkali metal-containing solution is recovered.

While various types of furnaces are contemplated for use in the process of this invention, the preferred furnace for carrying out the process of this invention is a multiple hearth furnace.

In accordance with one preferred aspect of the invention, the alkali metal-containing waste liquor is mixed with aluminum hydrate to form a slurry, and the slurry is directed into the upper end portion of a multiple hearth furnace and onto a bed of previously formed granules of aluminum hydrate and waste liquor solids located on an upper hearth of the furnace. Agitation is provided on this hearth of the furnace to facilitate drying of the mixture and formation therefrom of additional granules containing aluminum hydrate and waste liquor solids. The granules are advanced successively onto lower hearths of the furnace and the combustion and reaction of the granules take place as the granules are being advanced through the furnace and over the respective hearths thereof.

In accordance with another preferred aspect of the invention, the aluminum hydrate which is precipitated and separated from the recoverable alkali metal-containing solution is recylced and directed into the upper end portion of a multiple hearth furnace and onto an upper hearth of the furnace. Agitation is provided on such upper hearth to facilitate drying of the aluminum hydrate. The aluminum hydrate is advanced onto a lower hearth of the furnace where waste liquor is sprayed onto the aluminum hydrate while agitation is also provided to mix the aluminum hydrate and liquor, facilitating drying of the mixture and the formation of granules containing aluminum hydrate and waste liquor solids. The granules are advanced successively onto lower hearths of the furnace where combustion and reaction of the granules takes place as the granules are being advanced through the furnace and over the respective hearths thereof.

The process and apparatus of this invention are useful in the recovery of various alkali metal base spent liquors, such as sodium-base spent liquors and potassium-base spent liquors for example. This process and apparatus, while being particularly suited for treating waste liquors from pulping processes, is also applicable to the treatment of alkali metal-containing waste liquors from numerous other operations wherein it is desired to recover the alkali metal content of the waste liquor. In chemical industries having a waste stream of sodium or potassium salts of organic acids for example, the recovery process of this invention may be advantageously employed for the disposal of the organic acids and recovery of sodium or potassium. The present process and apparatus is also useful in a variety of applications where it is desired to convert sodium sulfate to sodium sulfite. As disclosed more fully hereinafter, the process and apparatus of this invention may also be employed for treating the red liquor waste stream from a trinitrotoluene (TNT) manufacturing operation for recovery of sodium and sulfur therefrom.

Some of the objects and advantages of this invention having been stated, other objects and advantages will appear as the description proceeds, when taken in conjunction with the accompanying drawings, in which —

FIG. 2 is a schematic diagrammatic flow diagram showing a second embodiment of the process and apparatus of this invention;

Figure 1:
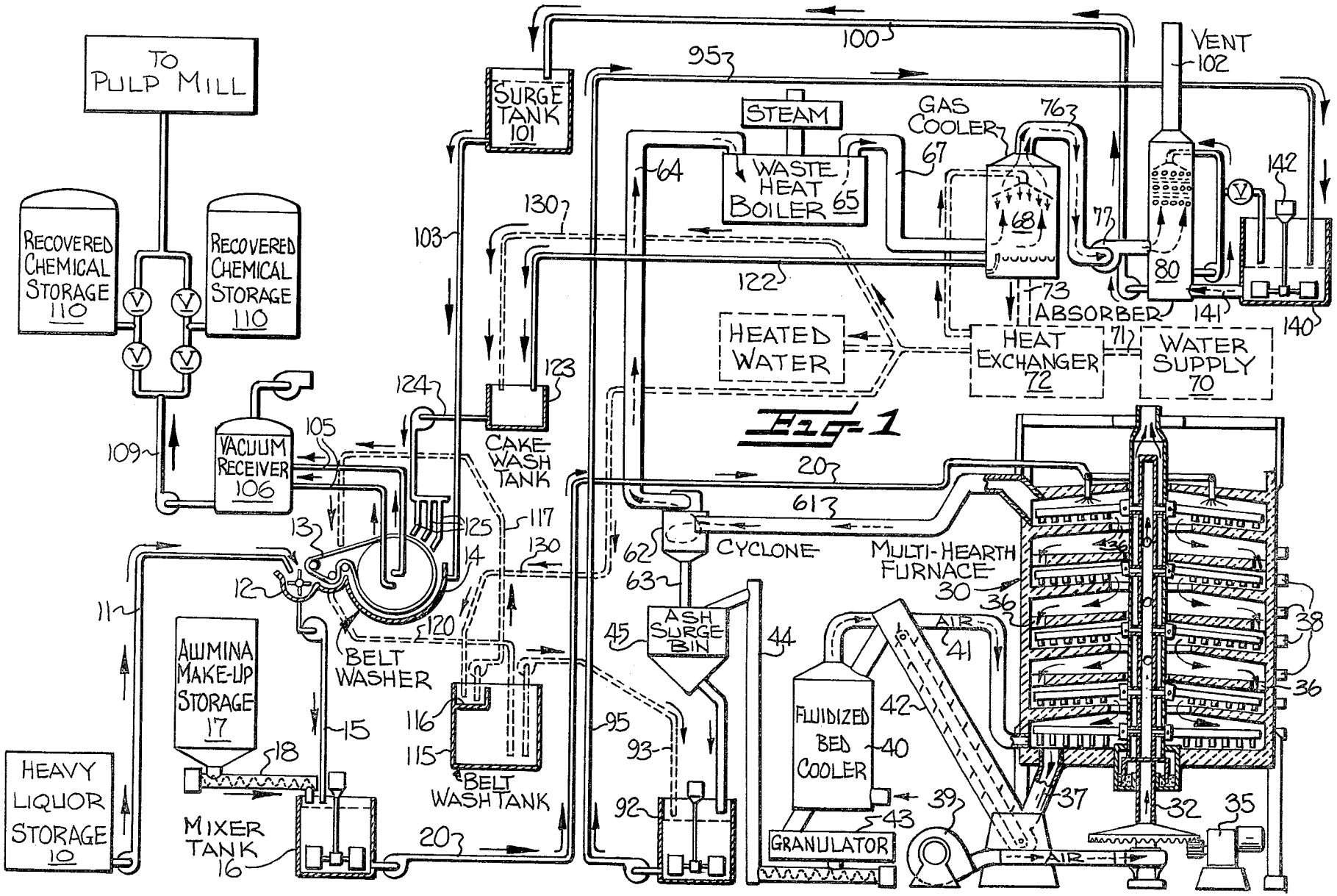
FIG. 1 is a schematic diagrammatic flow diagram showing a first embodiment of the process and apparatus of this invention.

Referring now more particularly to FIG. 1 of the drawings, the following is a general description of the process and apparatus of this invention as specifically applied to the treatment of spent liquor from a sodium base pulping operation or pulp plant. The treatment process and apparatus of this invention may also be applied to the treatment of alkali metal base spent liquors from operations other than pulping operations, and utilizing other alkali metals, such as potassium for example. This will become evident as the description proceeds and from the specific examples which follow.

Dilute waste liquor containing an alkali metal such as sodium is concentrated in multiple effect evaporators, not shown, and sent to a heavy liquor storage tank 10. From the heavy liquor storage tank 10, the concentrated liquor is pumped to a repulper 12 through enclosed conduit 11. Alumina (aluminum hydrate) cake from the belt 13 of belt washer 14 drops into the repulper 12 and is mixed with the liquor. A description of how the alumina cake is formed at the belt washer 14 will be given below. The resulting slurry is pumped into a mixer tank 16 through conduit 15. In the mixer tank 16, the liquor and alumina are thoroughly mixed, and such additional alumina as may be necessary to provide the desired ratio of alumina to liquor is added from the alumina make-up storage tank 17 by screw conveyor 18.

The proportions of alumina (aluminum hydrate) to spent liquor may be varied over a relatively wide range. In the case of a sodium base spent pulping liquor, the alumina may be provided in a ratio ranging from in excess of that amount necessary to provide a 1:1 stoichiometric relationship of alumina to sodium, to as low as about 25 to 30 percent stoichiometric alumina to sodium. It is only necessary that sufficient alumina be provided to react with at least a portion of the sodium in the spent liquor and to maintain the melting point of the resulting furnace ash above the operating temperature of the furnace to prevent the solid reactants from becoming sticky or molten.

From the mixing tank 16, the slurry is pumped through conduit 20 to a reaction furnace 30. Reaction furnace 30 may be any suitable type of furnace capable of handling materials therethrough in a solid form such as for example a rotary kiln, a moving grate furnace, or a multiple hearth furnace. In the preferred embodiment of the invention illustrated herein a multiple hearth furnace is employed. Exemplary of the many kinds of multiple hearth furnaces suitable for use in this invention is the Nichols Herreshoff furnace available from Nichols Engineering and Research Corporation. The furnace operates at a temperature below the fusion temperature of sodium aluminate, which is about 3,000 degrees F., so that the reaction mass does not become plastic or sticky at any stage. Preferably, the furnace operates at a temperature range between 1,500 degrees to 2,000 degrees F. to combust the organic content of the waste liquor solids and react the sodium content thereof with the alumina to form sodium aluminate as a particulate unfused ash.

Figure 3:
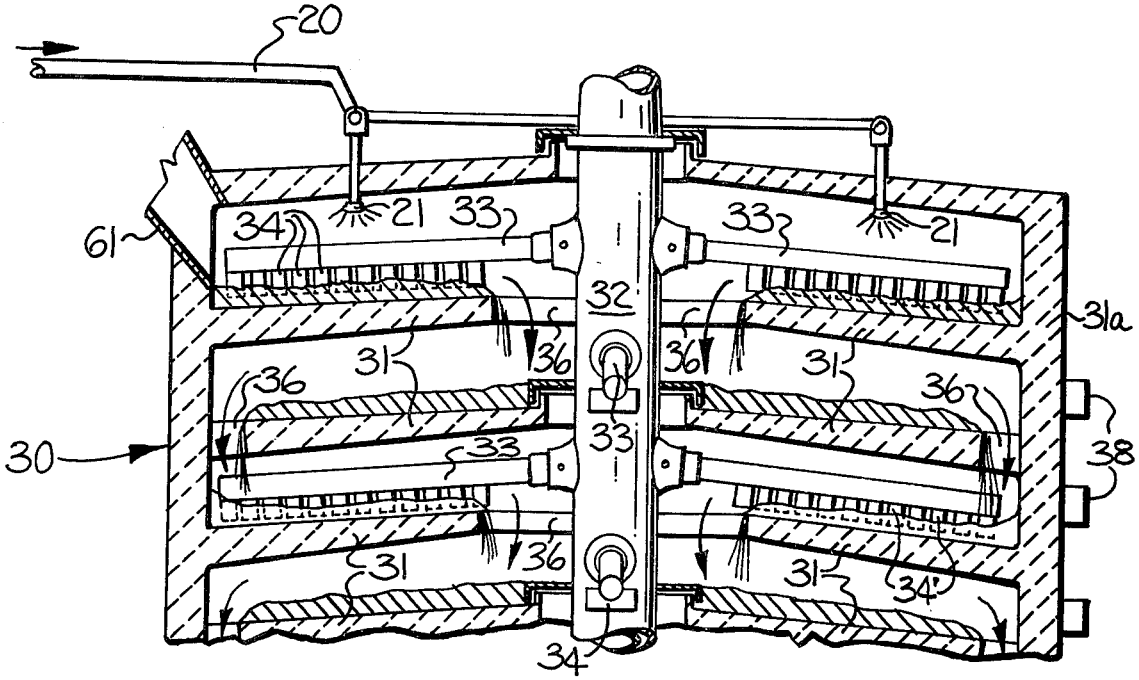
FIG. 3 is a fragmentary detailed cross sectional view of the arrangement for the multiple hearth furnace as utilized in the first embodiment of the invention.
Figure 4:
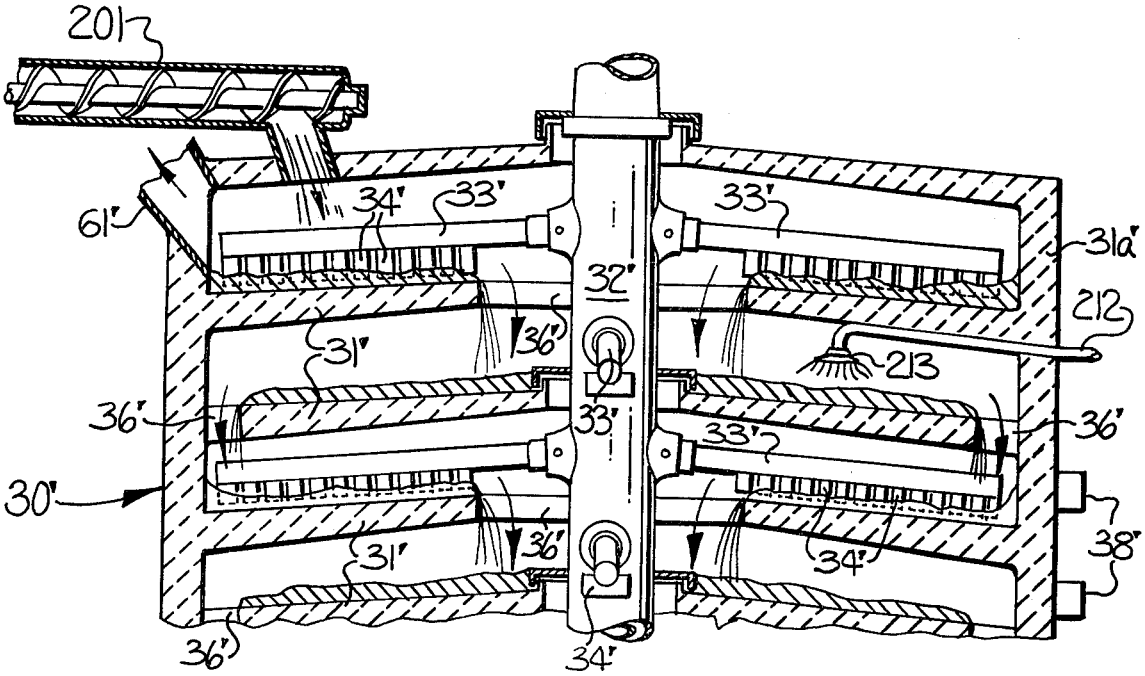
FIG. 4 is a view similar to FIG. 3, but showing the arrangement for the multiple hearth furnace as utilized in the second embodiment of the invention.

Referring more particularly to the multiple hearth reaction furnace 30, as shown in greater detail in FIG. 3, the furnace consists of a series of vertically stacked circular hearths 31 enclosed in a refractory lined casing 31*a*. A vertical hollow shaft 32 extending axially through the center of the furnace carries arms 33 with rabble blades 34 on each hearth. Shaft 32 is rotated by a motor 35, causing the rabble blades 34 to move across the hearths to stir the material on the respective hearths and move the material in a spiral path across each hearth. A fan 39 directs air into and through the hollow shaft 32 for cooling. (See FIG. 1.)

As illustrated, the slurry of spent liquor and alumina from mixer tank 16 is directed by conduit 20 into the upper portion of the furnace where it is sprayed from suitable nozzles 21 located above the uppermost hearth 31 onto a bed of previously formed granules containing alumina and liquor solids located on the top hearth. Due to the operating temperature of the furnace and the heated gases passing therethrough, the granular bed on the upper hearth is in a heated condition and as the slurry of alumina and spent liquor is sprayed onto the bed of granular material and mixed therewith by the action of the moving rabble blades 34, the slurry is quickly dried and forms additional granules containing alumina and spent liquor solids on the upper hearth. The rabble blades 34 continually mix and stir the granules on the top hearth, causing the material to be gradually moved across the hearth and to pass through drop holes 36 to the hearth below. However, the action of the rabble blades on the upper hearth is such that a depth of several inches of granular material is maintained on the upper hearth sufficient to serve as a bed for receiving and facilitating drying of the alumina and spent liquor slurry.

It will be appreciated that for purposes of initial start-up it will be necessary to provide a bed of granular material on the upper hearth for initially receiving the slurry. Granular alumina may be suitably used for this purpose. However, after initial start-up, with proper adjustment of the rabble blades, a sufficient bed of material will be maintained on the upper hearth for substantially continuous operation.

The rabble blades 34 on each hearth serve to mix the granular material and advance the same over and across each hearth of the furnace to the bottom hearth where furnace ash is discharged through an outlet port 37. During the advancing of the material through the furnace, burners 38 provided on one or more of the hearths heat the granular material in the furnace to combustion temperature to combust the organic content of the granules and react the sodium content with the alumina to form particulate sodium aluminate. Preheated secondary combustion air from a cooler 40 is introduced into the lower portion of the furnace by conduit 41 and this air joins hot combustion gases from the burners 38 on the lower hearths of the furnace. These hot gases flow countercurrent to the movement of granular material in the furnace, causing the granular material to be heated to combustion temperature as it progresses through the furnace and causing the granular material to combust and react. The hot gases also serve to heat and dry the alumina and waste liquor mixture on the upper hearth and assist in the formation of granules therefrom.

The fully combusted and reacted granular material leaves the furnace 30 by outlet port 37 and is directed therefrom to cooler 40. A conveyor 42 is shown for directing the furnace ash to the cooler. However, it will be understood that in many installations, depending upon the location and size of the processing equipment, it may be possible to discharge the furnace ash by gravity directly from the outlet port 37 into the cooler. In the embodiment of the invention illustrated herein, cooler 40 is of the fluidized bed type, but other types of cooling apparatus may be suitably employed. Secondary combustion air is drawn from the atmosphere up through cooler 40 and contacts the furnace ash located in the cooler, thus cooling the ash while preheating the combustion air. The cooled granular furnach ash passes from the cooler 40 into a granulator 43 where it is ground into more finely divided form to facilitate dissolving, and is then fed by way of a suitable solid materials conveyor 44 to ash surge bin 45.

Returning now to the gas flow through the process and apparatus of this invention, the hot combustion gases leaving the upper end of the furnace 30 are directed along a conduit 61 and pass through a cyclone 62 where entrained ash and dust are separated from the gas stream and returned by conduit 63 to the ash surge bin 45.

The hot gases then flow through conduit 64 into a waste heat boiler 65 where they are cooled to approximately 500 degrees F. and at the same time generate steam for use elsewhere in the process and apparatus. The semi-cooled gases then flow through a conduit 67 into a direct contact gas cooler 68. In the gas cooler 68, the gases are contacted with water which flows from a water supply 70, through conduit 71, through heat exchanger 72 and through conduit 73 into the cooler 68. The water is recycled in the gas cooler and exchanges its heat with fresh water in the heat exchanger 72. Gases are discharged from the gas cooler at about 150 degrees F. through conduit 76.

From the conduit 76, the gases pass through induced draft air fan 77, which originally causes atmospheric air to be drawn in through the cooler 40, and into an absorber 80. The absorber 80 which is illustrated herein is described more fully in commonly owned Sheeley et al U.S. Pat. No. 4,035,228, to which reference may be made for a more detailed description of the structure and operation of the absorber.

Referring again to the furnace ash, finely divided furnace ash from the ash surge bin 45 is fed into a dissolver or mixer tank 92 where it is slurried or mixed with water entering the dissolver tank from conduit 93. This thin slurry consists of dissolved sodium aluminate plus any unreacted alumina and other insoluble materials that may be present in the ash. The thin slurry is pumped through conduit 95 to a precipitator tank 140. The precipitator tank 140 is connected to the base of the absorber 80 by an open pipe 141 in such a manner that the liquid levels in the base of the absorber and in the precipitator tank are the same. Agitation of the liquid in the base of the absorber and in the precipitator tank is maintained by respective mixers 142.

As described more fully in the aforementioned commonly owned Sheeley et al U.S. Pat. No. 4,035,228, the material in precipitator tank 140 enters the absorber 80 through conduit 141 and is recirculated through the absorber where it is contacted with the incoming cooled gases entering the bottom of the absorber. The sodium aluminate reacts with and absorbs sulfur dioxide from the gas stream to form sodium sulfite and to precipitate aluminum hydrate in an easily separable particulate form.

Slurry is withdrawn from the base of the absorber and pumped through conduit 100 into a belt washer surge tank 101. The scrubbed flue gas is vented to the atmosphere through vent 102 in the top of the absorber 80.

The slurry flows from the surge tank 101 through conduit 103 into the belt washer filter apparatus 14. The belt 13 rotating through the belt washer 14 filters out the aluminum hydrate as a dense cake and drops it into the repulper 12 for subsequent reuse in the treatment process. The sodium sulfite solution passes through the belt 13, through conduits 105, and into a vacuum receiver 106. From the vacuum receiver 106, the sodium sulfite solution is pumped through conduit 109 into storage tanks 110 for subsequent use in the pulp mill and in the pulping processes.

The belt 13 of the belt washer 14 is continuously backwashed by water from the beltwash tank 115. In the beltwash tank, water for use in backwashing the belt 13 is trapped in a trough 116 and is pumped through conduit 117 onto the belt 13. The contaminated water from the lower part of the beltwash tank 115 is pumped to the mixer 92 for use in making up the thin slurry in mixer 92. This results in recovery of any alumina cake that is backwashed from the belt 13. Water from the belt 13 flows into the backwash tank 115 through conduit 120.

Contaminated water from the gas cooler 68 overflows from the base of the cooler through conduit 122 and into a cakewash tank 123. Water from the cakewash tank 123 is pumped to the sprayers 125 by conduit 124 for spraying water on the belt 13 of the belt washer 14 to completely wash the sodium sulfite solution from the alumina cake. Any dust that is collected in the contaminated water is recovered and added to the cake and the dissolved sulfur dioxide is absorbed by the sodium sulfite solution and is also recovered. Heated water from the heat exchanger 72 is available for use elsewhere in the recovery process, and in other operations, as in the pulp mill for example. As illustrated, hot make-up water is supplied through conduit 130 to both the cakewash tank 123 and the beltwash tank 115.

As mentioned earlier, the treatment process and apparatus of this invention is applicable to the treatment of alkali metal base spent liquors not only from pulping operations, but also from various other kinds of operations as well. FIG. 2 shows a modified form of the apparatus of this invention which is particularly suited for treating the relatively thin waste stream from a trinitrotoluene (TNT) manufacturing operation to recover the sodium and sulfur content thereof. The overall process and apparatus illustrated in FIG. 2 is similar in many respects to that previously described with reference to FIG. 1. To avoid repetitive description, those parts shown in FIG. 2 which correspond to similar parts shown and previously described with reference to FIG. 1 will bear the same reference characters with prime notation added where applicable, and only those elements which differ from the apparatus shown in FIG. 1 will be described here in detail.

Essentially, this modified form of the invention differs from the form previously described in that the waste liquor is mixed with the alumina on the hearth of the multiple hearth furnace rather than being premixed with the alumina as a slurry and deposited on the hearth as in the previous embodiment.

In accordance with this embodiment of the invention moist aluminum hydrate from the belt washer 14' is received at the discharge end of the belt washer and conveyed by suitable conveying mechanisms such as a screw conveyor 201 to the multiple hearth furnace 30'. As the alumina is directed to the furnace along the screw conveyor 201, such additional alumina as may be necessary to provide the desired ratio of alumina to liquor is added from the alumina make-up storage tank 17' by screw conveyor 18'.

Upon reaching the multiple hearth reaction furnace 30', the moist aluminum hydrate is discharged from screw conveyor 201 and deposited onto the upper hearth 31' of the furnace. Here the alumina is contacted by the heated gases passing through the furnace and drying of the moist alumina takes place. The moving rabble blades 34' on the upper hearth move the alumina across the upper hearth while continually mixing and stirring the alumina to facilitate drying and to leave the alumina in a granular state. Finally, the alumina, in dried or nearly dried condition, passes through the drop hole 36' of the upper hearth and is deposited onto the hearth below. On this second hearth the granular material is maintained to a depth of several inches to serve as a bed for receiving the waste liquor. The waste liquor from storage tank 10' is directed to the second hearth of the multiple hearth furnace by conduit 212 and sprayed by suitable nozzles 213 onto the bed of granular material. The moving rabble blades 34' mix the liquor with the alumina and facilitates drying and the formation of granules containing a mixture of alumina and spent liquor solids.

As in the previous embodiment, the rabble blades 34' on each hearth cause the granular material to be gradually moved across the respective hearths and to pass through drop holes 36' to the hearths below. As the granular material is advanced through the furnace, burners 38' provided on one or more of the hearths heat the granular material in the furnace to combustion temperature to combust the organic content of the granules and react the sodium content with the alumina to form particulate sodium aluminate furnace ash.

In treatment of many waste liquors, as for example spent pulping liquors, the organic content of the liquor is sufficient to supply the needed carbon to support combustion and provide a reducing atmosphere in the furnace for reduction of the alkali metal compounds. However, in the treatment of some waste streams, as for example the sodium and sulfur-containing red waste liquor stream from a TNT manufacturing operation, additional carbon must be provided and this may be supplied by mixing powdered coal, fuel oil, or any other convenient carbon-containing material with the waste liquor stream prior to introduction into the furnace. The amount of carbon to be added varies depending upon the carbon content of the liquor stream and upon other factors, and this can be readily ascertained by routine testing.

In the embodiment illustrated in FIG. 2, it will be noted that the waste liquor from storage tank 10' is directed by conduit 11' into a mixer tank 210 where powdered coal from a storage hopper 211 is added to the waste liquor and mixed therewith. The mixture is then directed by conduit 212 to the second hearth of the multiple hearth furnace and sprayed onto the bed of granular aluminum hydrate.

The furnace ash may be discharged through an outlet port 37' adjacent the bottom of the furnace and directed to a cooler 40' as in the previously illustrated embodiment.

Alternatively, if desired, the lowermost hearth of the multiple hearth furnace may be utilized for cooling of the granular furnace ash prior to discharge thereof from the furnace. In such event, the cooler may be eliminated entirely or significantly reduced in size.

EXAMPLE 1

69,500 Pounds per hour of 10% solids spent sulfite liquor is concentrated in suitable multiple effect evaporators to 11,584 pounds of 60% concentrated liquor containing 1,330 pounds of sodium as $Na_2O$ and 313 pounds of sulfur. The concentrated liquor is fed through a repulper and mixer where it is intimately mixed with 6,275 pounds per hour of recycled precipitated aluminum hydrate filter cake containing 2,510 pounds per hour of aluminum hydroxide. This mixture is fed continuously onto the top hearth of a multiple hearth furnace where it is mixed with granules of aluminum hydrate and liquor solids on the upper hearth, dried, and combusted as the granules pass across the additional hearths, reaching a maximum temperature of 1700 degrees F. The resulting combustion ash at a rate of 3,210 pounds per hour is cooled to 300 degrees F. by countercurrent draft air before going through a granulator, a surge bin, and finally to a dissolver tank where 14,735 pounds per hour of water are added to form a 5.5 percent solution of sodium aluminate and sodium carbonate as sodium. This solution is fed to the absorber. Hot flue gases from the furnace containing water vapor, $SO_2$, $CO_2$, etc. are fed through a cyclone where ash fines are precipitated and conveyed to the ash surge bin. From the cyclone the gases are carried through a waste heat boiler where heat is exchanged with water to generate 15,000 pounds per hour of 150 psig steam for use in the evaporators. The exit gases from the waste heat boiler at a temperature of 450 degrees to 500 degrees F. are carried to the gas cooler where cooling water is introduced. The cooled gases containing 626 pounds per hour of $SO_2$ and a large excess of $CO_2$ are carried into an absorber and are brought into countercurrent contact with slurry from the absorber base which is being recirculated continuously at a rate of 600 g.p.m. and has a pH value of 8.5. The entering (feed) solution (sodium aluminate and sodium carbonate) at 30 g.p.m. is fed to the precipitator tank where it is mixed with slurry recycled from the absorber base being fed into the precipitator tank at a rate of about 60 g.p.m. to maintain the pH value in the precipitator tank at a value of 10 to 11. A pH gradient is thus established which results in a gradual precipitation of aluminum hydrate and produces a particle size which is easy to filter. Discharge slurry is removed from the absorber base at 30 g.p.m. The discharge slurry has a pH of 8.5 and contains 1,230 pounds per hour of sodium sulfite and 1,240 pounds per hour of sodium bicarbonate in solution and insoluble aluminum hydrate as a slurry. The slurry is carried to the belt filter washer where filter cake of aluminum hydrate is removed and dropped into the repulper. The filtrate containing 1,230 pounds per hour of sodium sulfite, 1,240 pounds per hour of sodium bicarbonate and a small amount of sodium sulfide is carried to pulp plant chemical storage.

EXAMPLE 2

41,500 Pounds per hour of 10 percent solids soda pulp black liquor is concentrated in suitable multiple effect evaporators to 6,920 pounds per hour of 60 percent solids black liquor containing 1,500 pounds per hour of spent caustic soda. The concentrated liquor is fed through a repulper and mixer tank where it is intimately mixed with 7,310 pounds per hour of freshly precipitated aluminum hydrate filter cake containing 2,925 pounds of aluminum hydroxide $Al(OH)_3$.

This mixture is continuously fed into a direct-fired rotary kiln where it is sprayed onto a bed of granules containing liquor solids and aluminum hydrate. The liquor and aluminum hydrate mixture is mixed with the granules, dried to form additional granules, and combusted at a temperature of about 1800 degrees F. The resulting combustion ash at a rate of 3,100 pounds per hour is removed from the kiln to a cooler, cooled by countercurrent draft air, and directed through the granulator and ground ash bin. 3,100 Pounds per hour of kiln ash is fed through a dissolver mixer where water is added to form a 20 percent solution of sodium aluminate. This solution is fed to an absorber. Hot flue gases from the kiln are exhausted through a cyclone where ash fines are precipitated and carried into the dissolver mixer.

From the cyclone, the hot gases are carried to and through a waste heat boiler where heat is exchanged with water to generate 11,000 pounds per hour of evaporator processed steam. The exit gases from the boiler at a temperature of 450 degrees to 500 degress F. are carried to a gas cooler and the cooled gases containing a large excess of $CO_2$ are carried into the absorber and brought into contact countercurrently with slurry from the absorber base which is being recirculated through the absorber at a rate of 750 g.p.m. and has a pH value of 8.6. The entering feed solution of sodium aluminate at 20% solids and containing 3,100 pounds per hour of sodium aluminate is fed to the precipitator tank. Slurry from the base of the absorber is fed into the precipitator tank at a rate sufficient to maintain the pH in the precipitator tank at a value of 10.2. A pH gradient is thus established which produces an aluminum hydrate particle with good filtering and dewatering properties. The discharge volume from the absorber base is approximately equal to the feed flow. The discharge slurry contains 2,000 pounds per hour of soda ash ($Na_2CO_3$) and sodium bicarbonate ($NaHCO_3$) and/or sodium carbonate in solution, and aluminum hydrate is precipitated as a slurry. The slurry is carried through a surge tank into the belt washer where the aluminum hydrate filter cake is removed and carried into the repulper. The filtrate from the belt washed is fed to storage or chemically processed in any desired manner, such as causticizing, for subsequent use in the mill pulping operation.

EXAMPLE 3

Same as Example 1 except that, if only sodium sulfite is desired as the final pulp chemical produce, 380 pounds per hour of elemental sulfur is fed to the furnace for combustion along with the feed to provide the needed amount of $SO_2$ to react with all of the sodium content of the liquor preferential to reaction with $CO_2$.

EXAMPLE 4

Same as Example 1, except that the spent sulfite liquor to be processed has been modified to a raffinate resulting from the acidification of concentrated spent NSSC liquor with sulfuric acid stoichiometric to the sodium acetate and formate content followed by solvent extraction of the liberated acetic and formic acids with 2-butanone, as disclosed in U.S. Pat. No. 2,714,118, to form an extract and a raffinate, stripping the 2-butanone from the raffinate followed by additional raffinate concentration to 50–60 percent solids prior to mixing with aluminum hydrate for combustion in the multiple hearth furnace. In this case, the sulfur added to the raffinate by the sulfuric acid used in the acidification provides enough additional to convert essentially all of the sodium content of the spent liquor to sodium sulfite.

EXAMPLE 5

An effluent containing 10,000 pounds per hour of potassium salts of mixed organic acids at 20% solids is concentrated to a stream of 3,330 pounds per hour at 60% solids. The potassium content of the solids is 40% or 800 pounds per hour. This concentrated stream is mixed with 1,600 pounds (dry basis) of aluminum hydroxide, the latter having been recovered from the filter at 40% solids. This mixture is sprayed into the multiple hearth furnace as in Example 1, yielding potassium salts instead of sodium. The discharge product slurry from the absorber contains 1,400 pounds per hour of potassium bicarbonate at 20% solids. This can be causticized to give the hydroxide or processed chemically in any other desired manner.

EXAMPLE 6

10,000 Pounds per hour of a waste stream from a trinitrotoluene (TNT) manufacturing plant is concentrated from 10% solids to 2,000 pounds per hour of 50% solids red liquor. This liquor contains 320 pounds of sodium and 220 pounds of sulfur per hour. This concentrated liquor is mixed with 700 pounds per hour of powdered coal and the mixture is fed onto the bed of the second hearth of a multiple hearth furnace where it mixes with 1,085 pounds per hour of aluminum hydroxide which has been dried on the first hearth. Drying is completed on the second hearth and combustion takes place on the remaining hearths which reach temperatures of 1700 degrees F. or higher. 1,200 Pounds per hour of ash is discharged from the bottom of the furnace where it is cooled to 400 degrees F. in a cooler by countercurrent air. The ash is then ground, stored in a surge bin, and finally goes to a dissolver tank where it is added to about 400 gallons of water per hour to produce a 25% solution of sodium aluminate. The hot flue gases from the furnace pass through a cyclone, are cooled to 160 degrees F. and are then directed to the absorber. The solution of sodium aluminate is contacted with the cooled flue gases in the absorber and aluminum hydroxide is precipitated and sodium sulfite is formed. The discharge from the absorber is composed of a slurry of aluminum hydroxide in a solution of sodium sulfite at a pH of about 8.5. The slurry is carried to a belt filter washer where the filter cake is removed and conveyed back to the top hearth of the furnace for drying. The filtrate contains approximately 850 pounds of sodium sulfite which passes through a clarifier and finally to product storage.

In the drawings and specification there have been set forth preferred embodiments of the invention, and although specific terms are employed, they are used in a generic and descriptive sense only and not for purposes of limitation.

That which is claimed is:

1. A continuous process for recovering the alkali metal content of alkali metal-containing spent liquor, said process being particularly suited for the recovery of sodium or potassium from the spent liquor from pulping operations, and characterized by avoiding the recycling of furnace ash and formation of solid pellets therefrom, said process comprising:

a. directing a mixture of aluminum hydrate and alkali metal-containing waste liquor through a heated furnace operating at a temperature below the fusion temperature of alkali metal aluminate while drying the mixture in the furnace and forming dried granules of aluminum hydrate and waste liquor solids, and while combusting the organic content of the granules and reacting the alkali metal content of the granules with the alumina to form granular alkali metal aluminate furnace ash, b. removing the granular alkali metal aluminate furnace ash from the furnace and dissolving the alkali metal aluminate in water to form a solution of alkali metal aluminate, c. acidifying the alkali metal aluminate solution to precipitate aluminum hydrate and produce a slurry of insoluble aluminum hydrate in a solution containing the alkali metal, and d. separating from the thus formed slurry the insoluble aluminum hydrate for reuse in mixing with the waste liquor and the solution of alkali metal for recovery of the alkali metal content thereof.

2. A process according to claim 1 wherein the step of directing the mixture of aluminum hydrate and waste liquor through a heated furnace comprises mixing the alkali metal-containing waste liquor with recycled aluminum hydrate from step (d) and forming a slurry of the waste liquor and aluminum hydrate and spraying the slurry into the furnace and onto a bed of previously formed granules of aluminum hydrate and waste liquor solids and mixing the slurry therewith so that upon drying of the slurry in contact with the previously formed granules, additional granules of aluminum hydrate and waste liquor solids are produced.

3. A process according to claim 1 wherein the step of directing the mixture of aluminum hydrate and waste liquor through a heated furnace comprises directing the mixture into the upper end portion of a multiple hearth furnace and onto a bed of previously formed granules of aluminum hydrate and waste liquor solids located on an upper hearth of the furnace, and while agitating the mixture on such hearth to facilitate drying of the mixture and formation therefrom of additional granules of aluminum hydrate and waste liquor solids, and while also advancing the granules successively onto lower hearths of the furnace, and wherein the combustion and reaction of the granules take place as the granules are being advanced through the furnace and over the respective hearths thereof.

4. A process according to claim 1 wherein the step of directing the mixture of aluminum hydrate and waste liquor through a heated furnace comprises directing moist aluminum hydrate from step (d) into one end portion of the furnace and advancing the aluminum hydrate therethrough while drying the same in the furnace, and while spraying the waste liquor onto the aluminum hydrate as it is being advanced through the furnace and dried, and mixing the liquor with the alumina and drying the mixture to form granules of aluminum hydrate and waste liquor solids.

5. A process according to claim 1 wherein the step of directing the mixture of aluminum hydrate and waste liquor through a heated furnace comprises directing moist aluminum hydrate from step (d) into the upper end portion of a multiple hearth furnace and onto an upper hearth of the furnace, while stirring the aluminum hydrate and moving the same across such upper hearth to facilitate drying thereof, and while directing the aluminum hydrate onto a lower hearth of the furnace and spraying waste liquor onto the aluminum hydrate on such hearth while also stirring the aluminum hydrate and liquor to facilitate drying and the formation therefrom of granules containing aluminum hydrate and waste liquor solids, and while also directing the granules successively across and onto lower hearths of the furnace, and wherein the combustion and reaction of the granules take place as the granules are being advanced through the furnace and over the respective hearths thereof.

6. A continuous process for recovering the alkali metal content of alkali metal-containing spent liquor, said process being particularly suited for the recovery of sodium or potassium from the spent liquor from pulping operations, and characterized by avoiding the recycling of furnace ash and formation of solid pellets therefrom, said process comprising:

a. forming a slurry of concentrated alkali metal-containing waste liquor and aluminum hydrate by mixing the aluminum hydrate with the waste liquor in an amount sufficient to react with at least a portion of the alkali metal content of the liquor for the ultimate formation of alkali metal aluminate as a reaction product, b. spraying the slurry into one end of an elongate heated furnace operating at a temperature below the fusion temperature of alkali metal aluminate and onto a bed of previously formed granules of the aluminum hydrate and waste liquor located in the furnace, and mixing and drying the slurry in contact with the previously formed granules to produce additional granules of aluminum hydrate and waste liquor solids, c. progressively advancing the granules from said one end portion of the furnace to the opposite end portion thereof while maintaining a sufficient depth of granules adjacent said one end portion of the furnace to serve as a bed for receiving the slurry being sprayed into the furnace and to facilitate drying of the slurry, d. directing air into the opposite end portion of the furnace and through the furnace in a direction countercurrent to the granules being advanced through the furnace while combusting the organic content of the granules and reacting the alkali metal content thereof with the aluminum hydrate to form granular alkali metal aluminate furnace ash, e. removing the granular alkali metal aluminate furnace ash from the furnace and dissolving the same in water to form a solution of alkali metal aluminate, f. acidifying the alkali metal aluminate solution to effect precipitation of aluminum hydrate and produce a slurry of insoluble aluminum hydrate in a solution containing the alkali metal, and g. separating the insoluble aluminum hydrate from the thus formed slurry and recycling the aluminum hydrate for reuse in step (a) and recovering the solution of alkali metal for reuse of the alkali metal content thereof.

7. A continuous process for recovering the alkali metal content of alkali metal-containing spent liquor, said process being particularly suited for the recovery of sodium or potassium from the spent liquor from pulping operations, and characterized by avoiding the recycling of furnace ash and formation of solid pellets therefrom, and said process comprising:

a. directing recycled moist aluminum hydrate into one end portion of an elongate heated furnace operating at a temperature below the fusion temperature of alkali metal aluminate and advancing the aluminum hydrate therethrough while drying the same in the furnace, b. directing alkali metal-containing waste liquor to the furnace in an amount sufficient for reaction of at least a portion thereof with the aluminum hydrate in the furnace for the ultimate formation of alkali metal aluminate as a reaction product, c. spraying the waste liquor onto the aluminum hydrate in the furnace as the aluminum hydrate is being advanced through the furnace and dried and while mixing the liquor with the aluminum hydrate and drying the mixture to form granules of aluminum hydrate and waste liquor solids, d. progressively advancing the granules from said one end portion of the furnace toward the opposite end portion thereof while directing air into the opposite end portion of the furnace and through the furnace in a direction countercurrent to the granules being advanced through the furnace and while combusting the organic content of the granules and reacting the alkali metal content thereof with the aluminum hydrate to form granular alkali metal aluminate furnace ash, e. removing the granular alkali metal aluminate from the furnace and dissolving the same in water to form a solution of alkali metal aluminate, f. acidifying the alkali metal aluminate solution to effect precipitation of aluminum hydrate and produce a slurry of insoluble aluminum hydrate in a solution containing the alkali metal, and g. separating the insoluble aluminum hydrate from the thus formed slurry and recycling the aluminum hydrate for reuse in step (a) and recovering the solution of alkali metal for reuse of the alkali metal content thereof.

8. An apparatus for recovering the alkali metal content of alkali metal-containing waste liquor, said apparatus being particularly suited for the recovery of sodium or potassium from the spent liquor from pulping operations, and characterized by avoiding the recycling of furnace ash and formation of solid pellets therefrom, said apparatus comprising: means for mixing concentrated alkali metal-containing waste liquor with aluminum hydrate to form a slurry therefrom, an elongate furnace, means in said furnace adjacent one end thereof for maintaining a bed of dried granules of aluminum hydrate and waste liquor solids, means for directing the slurry of alkali metal-containing waste liquor and aluminum hydrate from said mixing means and into said one end of said elongate furnace and including means for spraying the slurry onto the bed of dried granules at said one end of the furnace, means in said furnace for mixing the slurry with the granules to facilitate drying thereof and produce additional granules of aluminum hydrate and waste liquor solids and for also advancing the granules through the furnace toward the opposite end thereof, means for heating the granules being advanced through the furnace to a temperature below the fusion temperature of alkali metal aluminate to combust the organic content of the granules and react the alkali metal content thereof with alumina to form granular alkali metal aluminate furnace ash, and means defining an outlet adjacent said opposite end of the furnace for discharge of the granular alkali metal aluminate furnace ash from the furnace, means for receiving the granular furnace ash from the furnace and for dissolving the same in water to form a solution of alkali metal aluminate, means for receiving the alkali metal aluminate solution and reacting the same with an acidic oxide gas to effect precipitation of aluminum hydrate and produce a slurry of insoluble aluminum hydrate in a solution containing the alkali metal, and means for receiving the slurry and separating therefrom the insoluble aluminum hydrate for reuse in said mixing means and the solution of alkali metal for recovery of the alkali metal content thereof.

9. An apparatus for recovering the alkali metal content of alkali metal-containing waste liquor, said apparatus being particularly suited for the recovery of sodium or potassium from the spent liquor from pulping operations, and characterized by avoiding the recycling of furnace ash and formation of solid pellets therefrom, said apparatus comprising: an elongate furnace, means for directing moist aluminum hydrate into one end of said elongate furnace, means in said furnace adjacent said one end thereof for receiving the moist aluminum hydrate and maintaining a bed thereof in the furnace, means in said furnace for agitating the moist aluminum hydrate and advancing the same through the furnace to facilitate drying of the moist aluminum hydrate, means located downstream from said one end of said furnace for spraying alkali metal-containing waste liquor onto the bed of aluminum hydrate being advanced through the furnace, means for mixing the alkali metal-containing waste liquor with the aluminum hydrate to facilitate drying thereof and the formation therefrom of granules of aluminum hydrate and waste liquor solids and for also advancing the granules through the furnace toward the opposite end thereof, means for heating the granules being advanced through the furnace to a temperature below the fusion temperature of alkali metal aluminate to combust the organic content of the granules and react the alkali metal content thereof with aluminum hydrate to form granular alkali metal aluminate furnace ash, and means defining an outlet adjacent said opposite end of the furnace for discharge of the granular alkali metal aluminate furnace ash from the furnace, means for receiving the granular furnace ash from the furnace and for dissolving the same in water to form a solution of alkali metal aluminate, means for receiving the alkali metal aluminate solution and reacting the same with an acidic oxide gas to effect precipitation of aluminum hydrate and produce a slurry of insoluble aluminum hydrate in a solution containing the alkali metal, means for receiving the slurry and separating therefrom the insoluble aluminum hydrate for reuse and the solution of alkali metal for recovery of the alkali metal content thereof, and means for receiving the insoluble aluminum hydrate and recycling the same to said elongated furnace.

* * * * *